US009165724B2

(12) United States Patent
Shen

(10) Patent No.: US 9,165,724 B2
(45) Date of Patent: Oct. 20, 2015

(54) CHANGE-OVER STRUCTURE BETWEEN MOVING CONTACT AND STATIC CONTACT OF TAP SELECTOR

(71) Applicant: Xu Shen, Shanghai (CN)

(72) Inventor: Xu Shen, Shanghai (CN)

(73) Assignee: SHANGHAI HUAMING POWER EQUIPMENT CO., LTD, Shanghai (CN)

( * ) Notice: Subject to any disclaimer, the term of this patent is extended or adjusted under 35 U.S.C. 154(b) by 255 days.

(21) Appl. No.: 13/793,781

(22) Filed: Mar. 11, 2013

(65) Prior Publication Data

US 2013/0306449 A1 Nov. 21, 2013

(51) Int. Cl.

| | |
|---|---|
| ***H01H 67/14*** | (2006.01) |
| ***H01H 9/00*** | (2006.01) |
| ***H01H 1/06*** | (2006.01) |
| ***H01F 29/04*** | (2006.01) |

(52) U.S. Cl.

CPC ..... *H01H 9/0016* (2013.01); *H01F 29/04* (2013.01); *H01H 1/06* (2013.01)

(58) Field of Classification Search

CPC . H01H 9/0005; H01H 9/0011; H01H 9/0016; H01H 9/0022; H01H 9/0027; H01H 9/0033; H01H 9/0038; H01H 9/0044; H01H 9/005; H01H 9/0055; H01H 9/0061

USPC ..... 335/111

See application file for complete search history.

(56) References Cited

U.S. PATENT DOCUMENTS

| | | | | |
|---|---|---|---|---|
| 3,174,097 | A * | 3/1965 | Bleibtreu | 323/340 |
| 3,238,320 | A * | 3/1966 | Bleibtreu | 200/11 TC |
| 3,612,786 | A * | 10/1971 | Whitman | 200/11 TC |
| 3,632,908 | A * | 1/1972 | Bleibtreu et al. | 200/11 TC |
| 3,902,030 | A * | 8/1975 | Popa | 200/11 TC |
| 5,056,377 | A * | 10/1991 | Yatchum et al. | 74/436 |
| 5,191,179 | A * | 3/1993 | Yatchum et al. | 200/11 TC |
| 5,523,535 | A * | 6/1996 | Larsson et al. | 200/11 TC |
| 6,060,669 | A * | 5/2000 | Dohnal et al. | 200/11 TC |
| 6,091,032 | A * | 7/2000 | Dohnal et al. | 200/11 TC |
| 6,693,247 | B1 * | 2/2004 | Byers et al. | 200/11 TC |
| 7,750,257 | B2 * | 7/2010 | Lindsey et al. | 200/11 TC |
| 8,330,063 | B2 * | 12/2012 | Xiao | 200/337 |

* cited by examiner

*Primary Examiner* — Shawki S Ismail
*Assistant Examiner* — Lisa Homza
(74) *Attorney, Agent, or Firm* — John P. White; Cooper & Dunham LLP

(57) ABSTRACT

A change-over structure disposed between a moving contact and a static contact of a tap selector includes an insulation changer base plate, static contacts which are fixed on the insulation changer base plate in at least one column at intervals, the inner ends of the static contacts are electrically connected to respective tap windings of a transformer, rotation shafts, each comprising moving contacts that are evenly distributed on each of the rotation shafts and are electrically connected to each other, and arc-shaped conductors corresponding to the static contacts in at least one column. Each of the arc-shaped conductors and outer ends of the static contacts are disposed at the same circumference with a center of one of the rotation shafts as a circle center. When one of the moving contacts is changed over between the two static contacts, another moving contact is electrically connected to the arc-shaped conductor.

5 Claims, 5 Drawing Sheets

CHANGE-OVER STRUCTURE BETWEEN MOVING CONTACT AND STATIC CONTACT OF TAP SELECTOR

BACKGROUND

1. Technical Field

The present invention relates to the technical field of on-load tap-changers of transformers, and particularly to a change-over structure between a moving contact and a static contact of a tap selector of a hanged combined-type on-load tap selector.

2. Related Art

For an on-load tap-changer, in the case that a transformer is on load, that is, is uninterrupted, a turn ratio of a primary winding to a secondary winding of the transformer is changed by changing winding taps connected to the transformer, so as to achieve the purpose of changing an output voltage of the transformer.

A combined-type on-load tap-changer is divided into two parts in terms of functions, that is, a change-over changer and a tap selector. As shown in FIG. 1, the upper part is a change-over changer A, and the lower part is a tap selector B. The resistor R is a transitional resistor. A main tap winding b of the transformer is serially connected to a main winding a of the transformer, the main tap winding b of the transformer has taps 1-12, where the taps 1, 3, 5, 7, 9, and 11 are located at an odd side and the taps 2, 4, 6, 8, 10, and 12 are located at an even side. As shown in FIG. 1, the selector is conductive at the position of the tap 3 at the odd side, and the tap 2 or tap 4 of the even side may be pre-selected in the non-conduction case. When the upper change-over changer is changed over to the right side, that is, the even side, the tap 2 or the tap 4 is conductive, thereby changing the number of turns of the winding of the transformer, and changing the turn ratio of the primary winding to the secondary winding of the transformer.

Referring to FIG. 2, the conventional combined-type on-load tap-changer selector adopts two concentrically rotating circle structures of equal diameter with a certain interval in an axial direction, where in one circle, static contacts connected to winding taps of the odd taps 1*b*, 3*b*, 5*b*, 7*b*, 9*b*, and 11*b* are circularly arranged, and in the other circle, static contacts connected to winding taps of the even taps 2*b*, 4*b*, 6*b*, 8*b*, 10*b*, and 12*b* are circularly arranged. In the conventional transformer, a winding of each phase has 10 to 18 voltage regulating taps. In this way, in each circle structure, 5 to 9 (in most cases, 9) static contacts are distributed, as shown in FIG. 2.

This concentrically rotating structure has a certain advantage in a combined-type on-load tap-changer of a buried vertical structure, but in a combined-type on-load tap-changer hanged and arranged horizontally, leads 1*a*, 2*a*, 3*a*, 4*a*, 5*a*, 6*a*, 7*a*, 8*a*, 9*a*, 10*a*, 11*a*, and 12*a* need to be connected to the static contacts 1*b*, 2*b*, 3*b*, 4*b*, 5*b*, 6*b*, 7*b*, 8*b*, 9*b*, 10*b*, 11*b*, and 12*b* of a on-load tap-changer selector on a wiring terminal C of an insulation plate. Since the on-load tap-changer is used in a high-voltage and large current environment, the leads la, 2*a*, 3*a*, 4*a*, 5*a*, 6*a*, 7*a*, 8*a*, 9*a*, 10*a*, 11*a*, and 12*a* cannot be connected with a flexible wire due to the action of an electromagnetic force, where a circular copper rod needs to be used to be bent and shaped. It can be seen from FIG. 2 that, the leads 1*a*, 2*a*, 3*a*, 4*a*, 5*a*, 6*a*, 7*a*, 8*a*, 9*a*, 10*a*, 11*a*, and 12*a* need to be bent to various shapes, so the manufacturing is difficult. Due to an inter-stage voltage, a certain interval needs to be ensured between the leads, so a large space is occupied, and the changer oil chamber needs to be large, that is, the cost of the apparatus is increased, and the consumption of the transformer oil is increased. Due to the action of the electromagnetic force, the positions of the leads are easily changed, easily causing an accident.

SUMMARY

The technical problem to be solved by the present invention is to provide a new change-over structure between a moving contact and a static contact of a tap selector, so as to solve the problem in the prior art in the process that the existing combined-type on-load tap-changer selector is applied in the hanged combined-type on-load tap-changer.

The technical problem to be solved by the present invention can be solved through the following technical solution.

A change-over structure between a moving contact and a static contact of a tap selector, including an insulation changer base plate, and further including:

at least two static contacts, fixed on the insulation changer base plate in at least one column at intervals, where inner ends of at least two static contacts are electrically connected to two tap windings of a transformer respectively;

at least one rotation shaft, where at least two moving contacts are evenly distributed on the at least one rotation shaft, and the at least two moving contacts are electrically connected to each other; and at least one arc-shaped conductor corresponding to the at least two static contacts in at least one column, where the at least one arc-shaped conductor and outer ends of the at least two static contacts in at least one column are located at the same circumference with a center of the rotation shaft as a circle center, and when one of the moving contacts is changed over between the two static contacts, the other moving contact is certainly electrically connected to the arc-shaped conductor.

In a preferred embodiment of the present invention, the number of static contacts is three, the three static contacts are fixed on the insulation changer base plate in at least one column at intervals, and inner ends of the three static contacts are electrically connected to three tap windings of the transformer respectively; outer ends of the three static contacts and the corresponding arc-shaped conductor are located at the same circumference with a center of the rotation shaft as a circle center, and when one of the moving contacts is changed over among the three static contacts, the other moving contact is certainly electrically connected to the corresponding arc-shaped conductor.

In a preferred embodiment of the present invention, when the number of the static contacts exceeds three, the static contacts are fixed on the insulation changer base plate in at least two columns at intervals, an inner end of each static contact is electrically connected to a corresponding tap winding of the transformer respectively; the number of static contacts in each column does not exceed three; according to a configuration of the number of columns of the static contacts and arc-shaped conductors the number of which corresponds to the number of columns of the static contacts, the arc-shaped conductors are electrically connected to each other; moving contacts the number of which corresponds to the number of columns of the static contacts are evenly distributed on the rotation shaft, and when one of the moving contacts is changed over between two static contacts in any column, a certain moving contact is certainly electrically connected to a certain arc-shaped conductor.

In a preferred embodiment of the present invention, the static contacts are divided into static contacts in an odd group or static contacts in an even group, three-phase static contacts in the odd group or in the even group are arranged in a direction parallel to an axial line of the corresponding rotation shaft in a row at intervals, the number of static contacts of each phase in the odd group or in the even group is nine, the nine static contacts are arranged in three columns at intervals, and in each column are three static contacts; the number of moving contacts corresponding to the static contacts of each phase in the odd group or in the even group is three, the three moving contacts are evenly distributed on the rotation shaft and are electrically connected to one another, the number of arc-shaped conductors corresponding to the static contacts of each phase in the odd group or in the even group is also three, the three arc-shaped conductors are electrically connected to one another, each arc-shaped conductor corresponds to a column of static contacts, and when one of the moving contacts is changed over between two static contacts in any column, at least one moving contact is certainly electrically connected to a certain arc-shaped conductor.

In a preferred embodiment of the present invention, the arc-shaped conductor is an arc-shaped conductor with a section of a circular shape.

Since the present invention adopts the foregoing technical solution, compared with the prior art, the present invention has the following significant advantages:

1. Connection conductors in the changer are omitted, so that each component is fixed and reliable and is convenient to mount, and hidden fault troubles are reduced.

2. The structure is small, so that the space occupied by the selector can be reduced, thereby reducing the volume of the changer, reducing the cost of the material and the consumption of the transformer oil.

DETAILED DESCRIPTION

The following embodiments further describe the present invention, but the embodiments are only intended to illustrate the present invention rather than limit the present invention.

Figure 1:
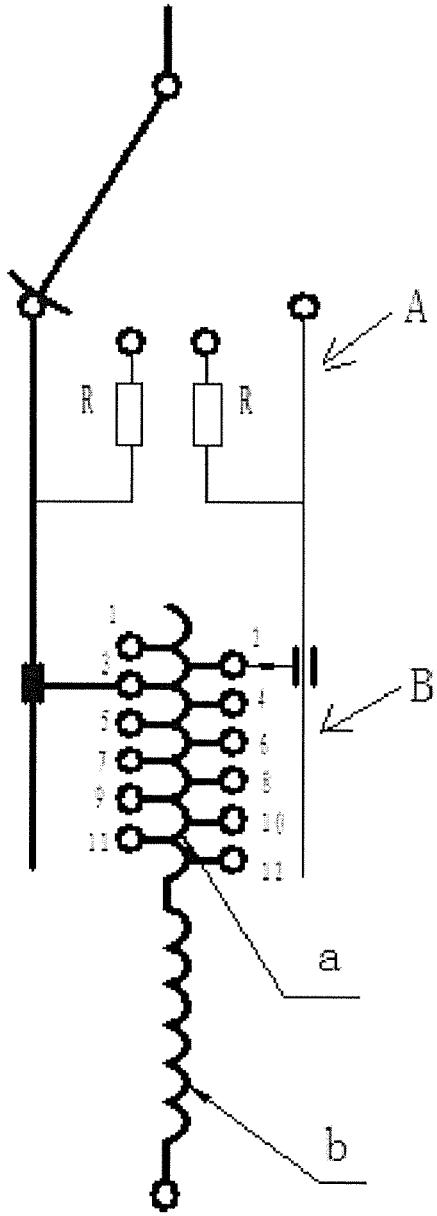
FIG. 1 PRIOR ART
FIG. 1 is a schematic diagram of a circuit principle of an existing combined-type on-load tap-changer.
Figure 2:
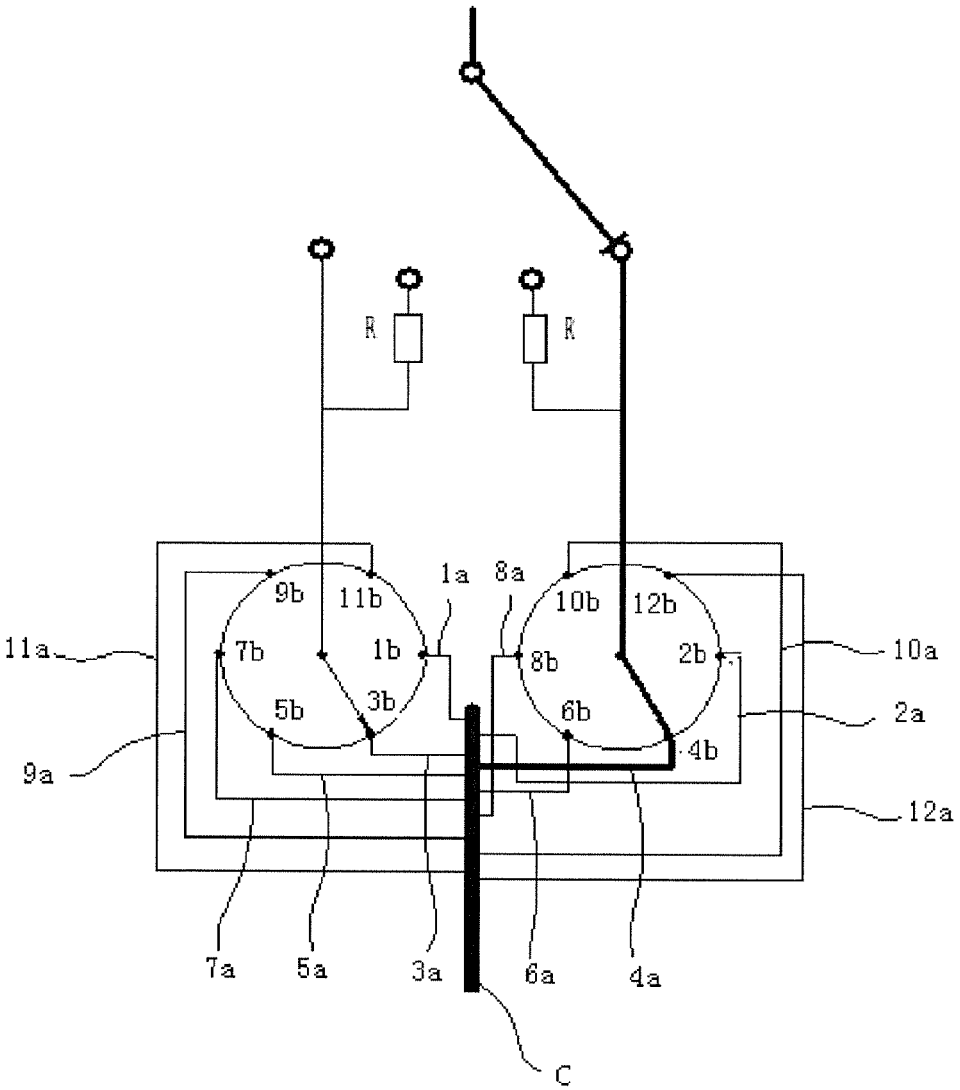
FIG. 2 PRIOR ART
FIG. 2 is a schematic diagram of a circuit structure of a conventional combined-type on-load tap-changer.
Figure 3:
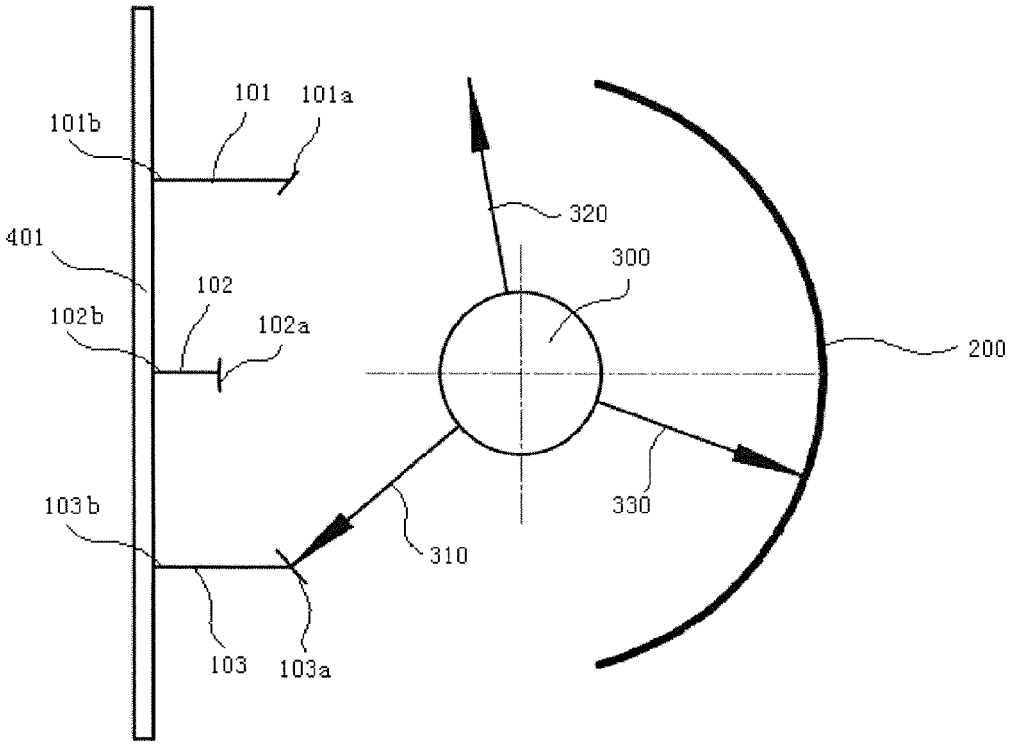
FIG. 3 is a schematic diagram of a circuit connection principle of a change-over structure between a moving contact and a static contact of a tap selector of the present invention.

Referring to FIG. 3, FIG. 3 is a schematic diagram of a circuit connection principle of a change-over structure between a moving contact and a static contact of a tap selector of the present invention.

In the schematic diagram of the circuit connection principle of the change-over structure between the moving contact and the static contact of the tap selector of the present invention shown in FIG. 3, the number of the static contacts is three, the static contacts are a static contact 101, a static contact 102 and a static contact 103 respectively. The three static contacts 101, 102, and 103 are fixed on a changer insulation base plate 401 and are arranged in a column. At the other side of the insulation base plate 401, inner ends 101*b*, 102*b*and 103*b* of the three static contacts 101, 102, and 103, respectively, are electrically connected to tap windings of a transformer respectively. The static contacts 101 and 103 are long and the static contact 102 is short. In this way, outer ends 101*a*, 102*a*, and 103*a* of the three static contacts 101, 102, and 103 and an arc-shaped conductor 200 are located on the same circumference with a rotation shaft 300 as a circle center. Three moving contacts 310, 320, and 330 are evenly distributed on the rotation shaft 300 with an interval of 120 degrees. The three moving contacts 310, 320, and 330 are electrically connected to one another. Definitely, for the schematic diagram of the circuit connection principle of the change-over structure between the moving contact and the static contact of the tap selector of the present invention shown in FIG. 3, two moving contacts may also evenly distributed on the rotation shaft 300 with an interval of 180 degrees. The arc-shaped conductor 200 is an arc-shaped conductor with a section of a circular shape.

According to FIG. 3, when the tap selector performs tap selection, the rotation shaft 300 rotates. In the process that the moving contact 310 is changed over from the static contact 102 to the static contact 103, the moving contact 330 is always electrically connected to the arc-shaped conductor 200. In the process that the moving contact 310 is changed over from the static contact 102 to the static contact 101, the moving contact 330 and/or the moving contact 320 is always electrically connected to the arc-shaped conductor 200. Through the principle, a lead is not required to be connected to a static contact of an on-load tap-changer selector on a wiring terminal of an insulation plate, thereby solving the problem in the prior art.

According to the principle of FIG. 3 and in combination with the number of voltage regulating windings of the transformer, the number and arrangement manners of static contacts, moving contacts, and arc-shaped conductors described in the present invention can be changed randomly. For lack of space, the present invention is described in combination with only one specific application manner in the following.

Figure 4:
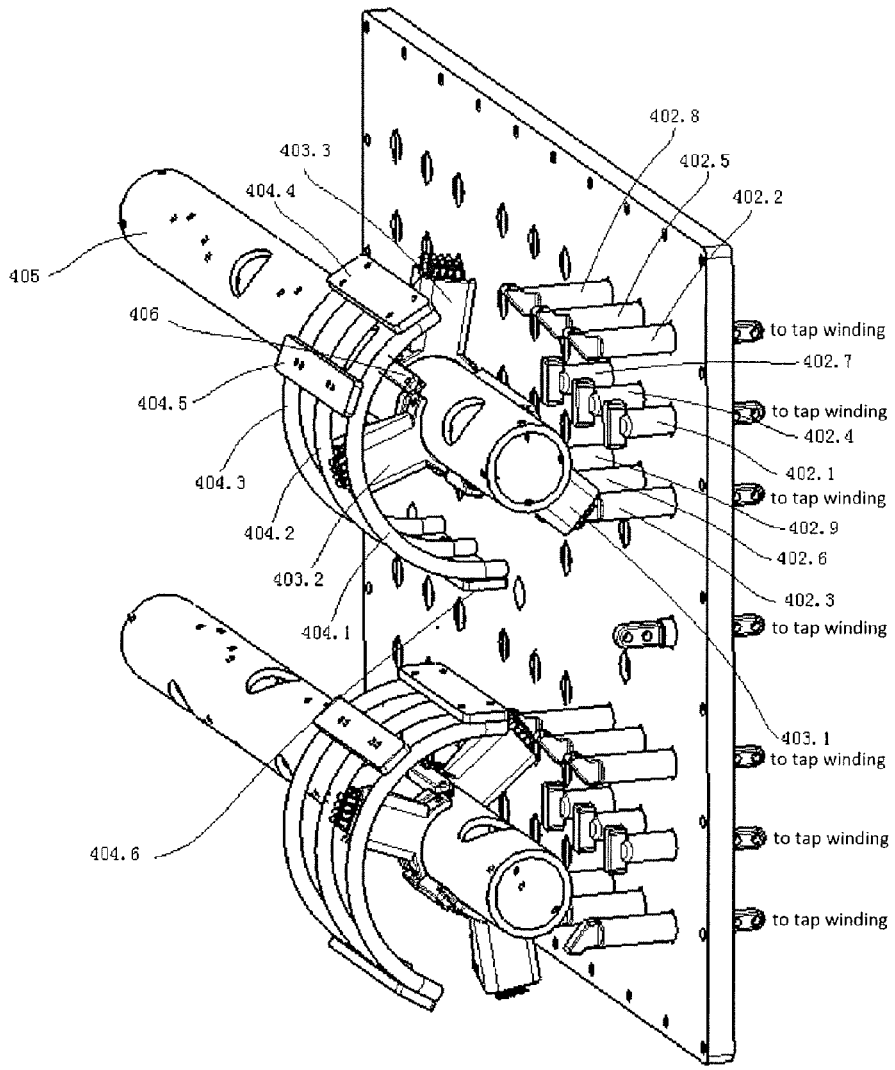
FIG. 4 is a schematic structural diagram of an embodiment of a change-over structure between a moving contact and a static contact of a tap selector of the present invention.

Referring to FIG. 4, an embodiment shown in FIG. 4 is a one-phase tap selector. The tap selector, in combination with the number of the voltage regulating windings of the transformer, is divided into two rotating structures in terms of an odd group and an even group, which are arranged in parallel in upper and lower positions.

The number of static contacts in an odd group of each phase is nine, the nine static contacts, 402.1, 402.2, 402.3, 402.4, 402.5, 402.6, 402.7, 402.8, and 402.9, in the odd group are divided into three columns, axially arranged along the rotation shaft 405 with distances determined by a changer-level voltage values and a structural size of the moving contact and fixed on the changer insulation base plate 401. Inner ends of the nine static contacts 402.1, 402.2, 402.3, 402.4, 402.5, 402.6, 402.7, 402.8, and 402.9, in the odd group are electrically connected to the nine odd tap windings corresponding to the transformer respectively (not shown).

The static contacts 402.1, 402.2, and 402.3 in the odd group form a column, where the static contact 402.1 in the odd group is located in the middle, and the static contacts 402.2 and 402.3 in the odd group are located at upper and lower sides.

The static contacts 402.4, 402.5, and 402.6 in the odd group form a column, where the static contact 402.4 in the odd group is located in the middle, and the static contacts 402.5 and 402.6 in the odd group are located at upper and lower sides.

The static contacts 402.7, 402.8, and 402.9 in the odd group form a column, where the static contact 402.7 in the odd group is located in the middle, and the static contacts 402.8 and 402.9 in the odd group are located at upper and lower sides.

The static contacts 402.1, 402.4, and 402.7 in the odd group in the middle are short, and the static contacts 402.2, 402.3, 402.5, 402.6, 402.8, and 402.9 in the odd group at the two sides are long, so that an end portion of each static contact in contact with the moving contact is located on the same circumference with a rotation center of the moving contact as a circle center.

Corresponding to the three columns of static contacts in the odd group, three moving contact groups 403.1, 403.2, and 403.3 in an odd group are arranged at intervals on the rotation shaft 405. The three moving contact groups 403.1, 403.2, and 403.3 are arranged corresponding to the three columns of static contacts in the odd group, with axial distances of the three columns of static contacts in the odd group, in an axial direction of the rotation shaft 405, and with an interval of 120 degrees on the circumference. The three moving contact groups 403.1, 403.2, and 403.3 are electrically connected to one another through a conductor 406. The conductor 406 is fixed on the rotation shaft 405.

Three arc-shaped conductors 404.1, 404.2, and 404.3 are disposed corresponding to the three moving contact groups 403.1, 403.2, and 403.3. Axial positions of the three arc-shaped conductors 404.1, 404.2, and 404.3 correspond to those of the three moving contact groups 403.1, 403.2, and 403.3 respectively, so that in the tap change-over process, the three moving contact groups 403.1, 403.2, and 403.3 can be electrically connected to the three arc-shaped conductors 404.1, 404.2, and 404.3 respectively or simultaneously. The three arc-shaped conductors 404.1, 404.2, and 404.3 are electrically connected to one another through conductors 404.4, 404.5, and 404.6. The three arc-shaped conductors 404.1, 404.2, and 404.3 are all arc-shaped conductors with sections of circular shapes.

Corresponding to the moving contact group 403.1 and the arc-shaped conductor 404.1, the static contacts 402.1, 402.2, and 402.3 in the odd group and the arc-shaped conductor 404.1 are in the same circumference with the center of the rotation shaft 405 as a circle center, and the static contacts 402.1, 402.2, and 402.3 in the odd group are arranged on the same circumference with the center of the rotation shaft 405 as the circle center and with an interval of 40 degrees.

Corresponding to the moving contact group 403.2 and the arc-shaped conductor 404.2, the static contacts 402.4, 402.5, and 402.6 in the odd group and the arc-shaped conductor 404.2 are in the same circumference with the center of the rotation shaft 405 as a circle center, and the static contacts 402.4, 402.5, and 402.6 in the odd group are arranged on the same circumference with the center of the rotation shaft 405 as the circle center and with an interval of 40 degrees.

Corresponding to the moving contact group 403.3 and the arc-shaped conductor 404.3, the static contacts 402.7, 402.8, and 402.9 in the odd group and the arc-shaped conductor 404.3 are in the same circumference with the center of the rotation shaft 405 as a circle center, and the static contacts 402.7, 402.8, and 402.9 in the odd group are arranged on the same circumference with the center of the rotation shaft 405 as the circle center and with an interval of 40 degrees.

For each phase, the number and arrangement manner of static contacts, moving contact groups, arc-shaped conductors and the rotation shaft in an even group are the same as the number and arrangement manner of static contacts, moving contact groups, arc-shaped conductors and the rotation shaft in the odd group. The only difference is that, on the changer insulation base plate 401, the even group is located below the odd group.

In the position shown in FIG. 4, the electrical connection path is from the arc-shaped conductor 404.2, to the moving contact 403.2, to the conductor 406, to the moving contact 403. 1, and to the static contact 402.3

Figure 5:
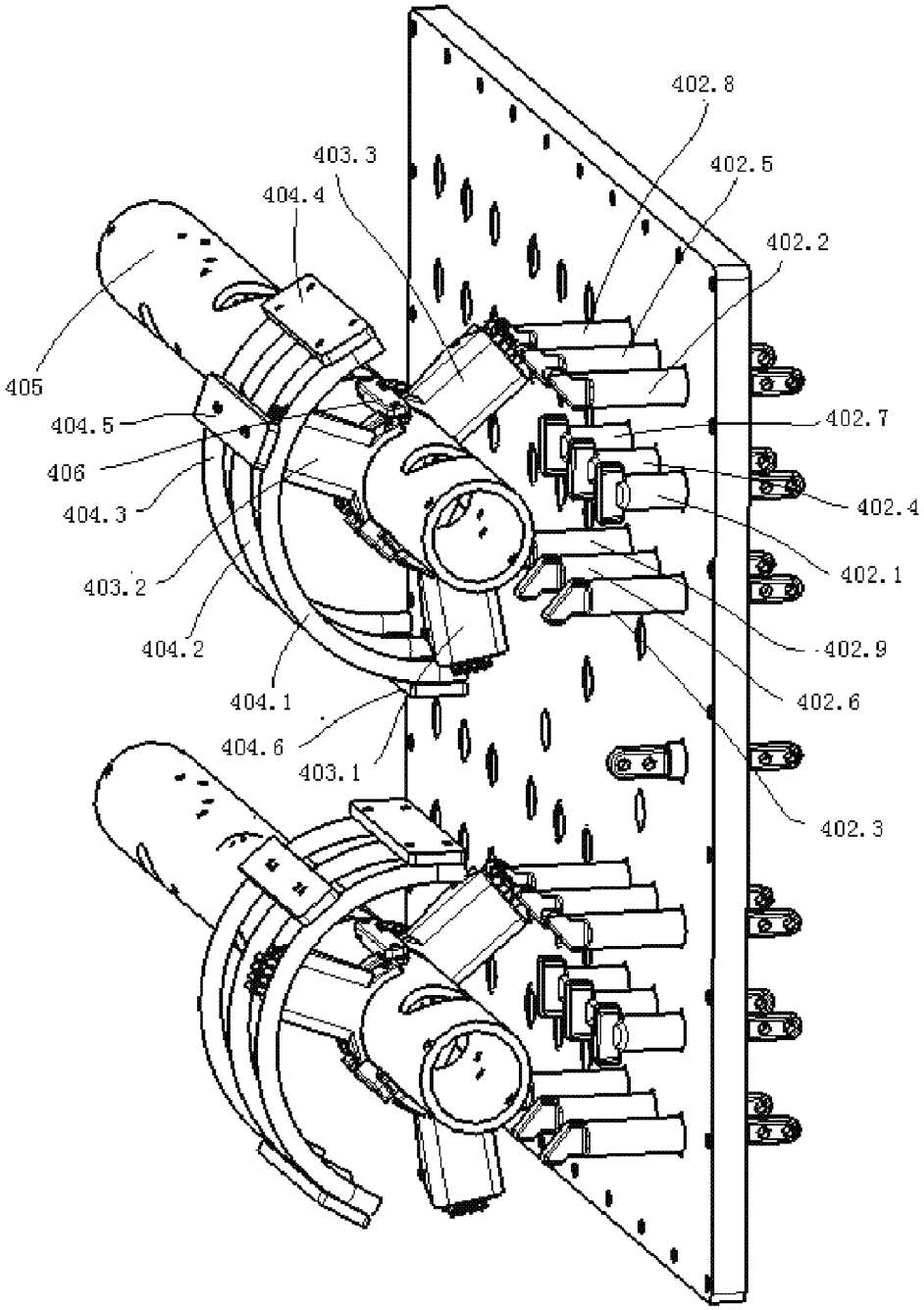
FIG. 5 is a schematic diagram that the change-over structure between the moving contact and the static contact of the tap selector shown in FIG. 4 is changed over to another state.

After the rotation shaft 405 performs rotation of 40 degrees clockwise, the position is shown in FIG. 5, where the electrical connection path is from the arc-shaped conductors 404.1 and 404.2, to the moving contacts 403.1 and 403.2, to the conductor 406, to the moving contact 403. 3, and to the static contact 402.8.

According to the foregoing structure and principle, under the driving of a changer manipulation mechanism, with the rotation of the rotation shaft, the moving contact in the odd group or the even group can select among the nine static contacts, thereby achieving the effect of changing and connecting voltage regulation winding taps of the transformer.

The foregoing content shows and describes the basic principle and main features of the present invention and the advantages of the present invention. Persons skilled in the art should understand that, the present invention is not limited to the embodiments. The embodiments and description of the specification are only intended to describe the principle of the present invention. Various variations and improvements can be made to the present invention without departing from the script and scope of the present invention, and the variations and improvements should all fall within the protection scope claimed in the present invention. The protection scope claimed in the present invention is defined by the appended claims and equivalents thereof.

What is claimed is:

1. A change-over structure disposed between a moving contact and a static contact of a tap selector, comprising:

an insulation changer base plate;

at least two static contacts, fixed on the insulation changer base plate in at least one column at intervals, wherein inner ends of at least two static contacts are electrically connected to respective tap windings of a transformer;

at least one rotation shaft, wherein at least two moving contacts are evenly distributed on the at least one rotation shaft, and the at least two moving contacts are electrically connected to each other; and at least one arc-shaped conductor corresponding to the at least two static contacts in at least one column wherein the at least one arc-shaped conductor and outer ends of the at least two static contacts in at least one column are located at the same circumference with a center of the at least one rotation shaft as a circle center, and when one of the moving contacts is changed over between the two static contacts, the other moving contact is electrically connected to the arc-shaped conductor.

2. The change-over structure disposed between a moving contact and a static contact of a tap selector according to claim 1, wherein the number of static contacts is three, the three static contacts are fixed on the insulation changer base plate in at least one column at intervals, and inner ends of the three static contacts are electrically connected to three tap windings of the transformer respectively; outer ends of the three static contacts and the corresponding arc-shaped conductor are located at the same circumference with a center of the at least one rotation shaft as a circle center, and when one of the moving contacts is changed over among the three static contacts, the other moving contact is electrically connected to the corresponding arc-shaped conductor.

3. The change-over structure disposed between a moving contact and a static contact of a tap selector according to claim 1, wherein when the number of the static contacts exceeds three, the static contacts are fixed on the insulation changer base plate in at least two columns at intervals, an inner end of each static contact is electrically connected to a corresponding tap winding of the transformer respectively; the number of static contacts in each column does not exceed three; according to a configuration of the number of columns of the static contacts and arc-shaped conductors, the number of which corresponds to the number of columns of the static contacts, the arc-shaped conductors are electrically connected to each other; moving contacts the number of which corresponds to the number of columns of the static contacts are evenly distributed on the at least one rotation shaft, and when one of the moving contacts is changed over between two static contacts in any column, another moving contact is electrically connected to an arc-shaped conductor.

4. The change-over structure disposed between a moving contact and a static contact of a tap selector according to claim 1, wherein the static contacts are divided into static contacts in an odd group or static contacts in an even group, three-phase static contacts in the odd group or in the even group are arranged in a direction parallel to an axial line of the corresponding rotation shaft in a row at intervals, the number of static contacts of each phase in the odd group or in the even group is nine, the nine static contacts are arranged in three columns at intervals, and in each column are three static contacts; the number of moving contacts corresponding to the static contacts of each phase in the odd group or in the even group is three, the three moving contacts are evenly distributed on the at least one rotation shaft and are electrically connected to one another, the number of arc-shaped conductors corresponding to the static contacts of each phase in the odd group or in the even group is also three, the three arc-shaped conductors are electrically connected to one another, each arc-shaped conductor corresponds to a column of static contacts, and when one of the moving contacts is changed over between two static contacts in any column, another moving contact is electrically connected to an arc-shaped conductor.

5. The change-over structure disposed between a moving contact and a static contact of a tap selector according to claim 1, wherein the arc-shaped conductor is an arc-shaped conductor with a section of a circular shape.

* * * * *